US006302093B1

(12) United States Patent
Holland

(10) Patent No.: US 6,302,093 B1
(45) Date of Patent: Oct. 16, 2001

(54) BOWSTRING RELEASE DEVICE

(76) Inventor: Jeffrey James Holland, N2028 385$^{th}$ St., Maiden Rock, WI (US) 54750

( * ) Notice: Subject to any disclaimer, the term of this patent is extended or adjusted under 35 U.S.C. 154(b) by 0 days.

(21) Appl. No.: 09/616,332

(22) Filed: Jul. 15, 2000

(51) Int. Cl.$^{7}$ ..... F41B 5/18
(52) U.S. Cl. ..... 124/35.2
(58) Field of Search ..... 124/35.2; 411/400, 411/401

(56) References Cited

U.S. PATENT DOCUMENTS

| | | | | |
|---|---|---|---|---|
| 350,209 | * | 10/1886 | Parmelee . | |
| 464,465 | * | 12/1891 | Rogers . | |
| 2,133,650 | | 10/1938 | Baker | 124/35.2 |
| 2,488,597 | | 11/1949 | Konold | 124/35.2 |
| 3,608,090 | | 9/1971 | Wilson | 2/21 |
| 3,656,467 | | 4/1972 | Halter | 124/35.2 |
| 3,768,456 | | 10/1973 | Hansen | 124/35.2 |
| 4,458,659 | * | 7/1984 | Troncosco . | |
| 4,620,524 | * | 11/1986 | Saunders . | |
| 5,692,490 | * | 12/1997 | Walker | 124/35.2 |

FOREIGN PATENT DOCUMENTS

WO 91/04453 9/1989 (WO) .

* cited by examiner

*Primary Examiner*—John A. Ricci
(74) *Attorney, Agent, or Firm*—Rudolf O. Siegesmund

(57) ABSTRACT

A bow string release device comprises a rod shaped into a ring with a curved tail. The ring portion is placed upon the archer's middle finger and positioned near the finger's first joint. The tail is placed to the front of the bowstring and hooked or grasped by the index finger. The bowstring is then pulled back and released by the index finger letting go of the tail.

7 Claims, 2 Drawing Sheets

FIG 3
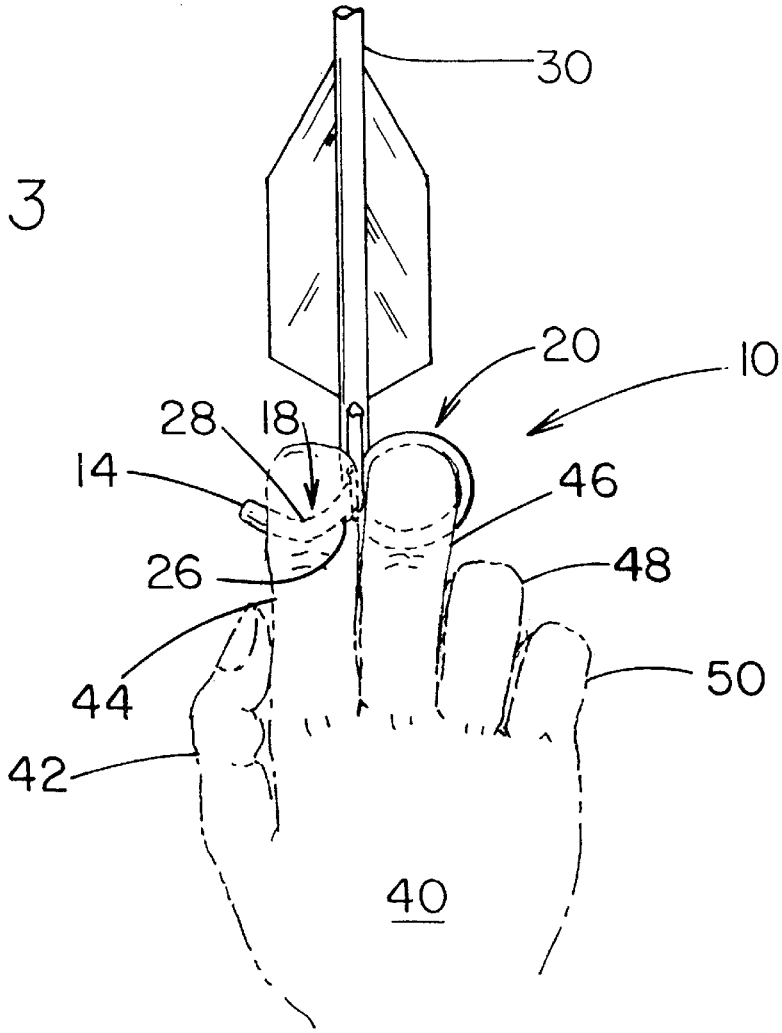
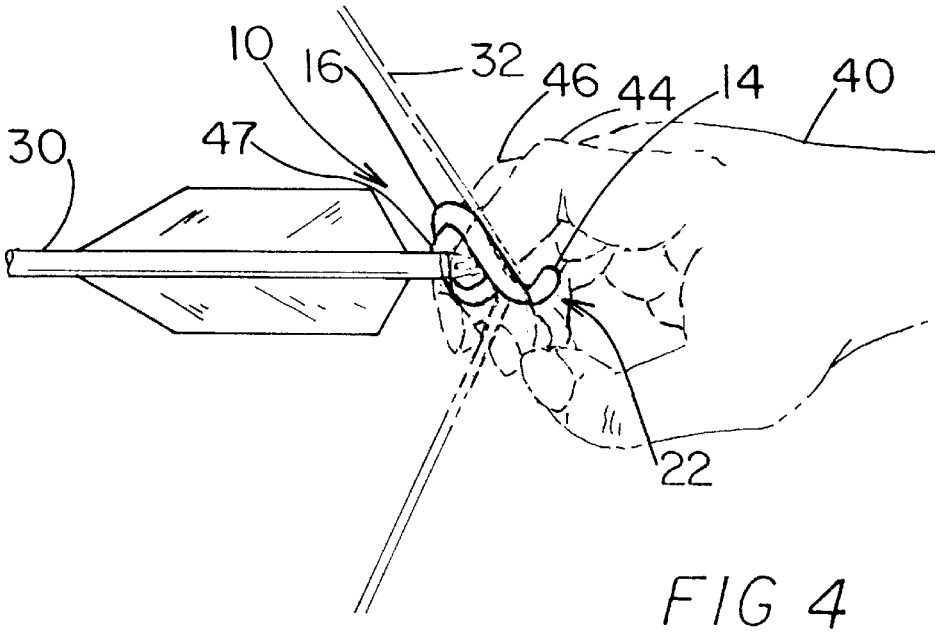
FIG 4

BOWSTRING RELEASE DEVICE

BACKGROUND OF THE INVENTION

1. Field of the Invention

The present invention relates to an apparatus for holding and releasing the bow string of an archery bow with the archer's bow string hand.

2. Description of the Prior Art

Bow string releases have been designed so that an archer can release the string of his or her bow with reduced fatigue on the muscles of the hand and fingers while holding the bowstring in a drawn position. The bow string release devices can also improve accuracy. U.S. Pat. No. 3,768,456 discloses a bow string release having an opening for the index finger, an arm with grooves for two fingers and a notch with an adjustable flange for holding the bow string. The notch and flange hold the bowstring and a rotation of the arm about the index finger releases the bow string. U.S. Pat. No. 3,656,467 discloses a one piece bow string release device with a central extension having a notch for engaging the bow string and two curved sections for engaging the index and middle finger of the archer's bow string hand. Squeezing the two fingers together causes a slight rotation of the central extension releasing the bow string. U.S. Pat. No. 3,608,090 discloses a protective tab to protect the archer's fingers when drawing the bow string. U.S. Pat. No. 2,488,697 discloses a mechanical bow trigger mechanism. U.S. Pat. No. 2,113,650 discloses a rectangular grip for the hand with a forward extending projection with notch for the bow string.

What is needed beyond the prior art is a device that does not rely on a forward projection or arm with notch for release of the bowstring. What is further needed beyond the prior art is a device that will provide the protection of the archer's tab while providing positive control of the bow string and positive control of the release of the bow string.

SUMMARY OF THE INVENTION

The present invention meets the needs and solves the problems identified above by providing a rod shaped into a ring with a curved tail. The ring portion is placed upon the archer's middle finger and positioned near the finger's first joint. The tail is placed in front of the bowstring and hooked or grasped by the index finger. The bowstring is then pulled back and released by the index finger letting go of the tail.

The foregoing and other objects, features and advantages of the invention will be apparent from the following more particular description of a preferred embodiment of the invention, as illustrated in the accompanying drawings wherein like reference numbers represent like parts of the invention.

BRIEF DESCRIPTION OF THE DRAWINGS

FIG. 3 is a top view of the device employed on an archer's hand with bowstring and arrow.

FIG. 4 is a left side view of the device employed on an archer's hand with bowstring and arrow.

DESCRIPTION OF PREFERRED EMBODIMENTS

Figure 1:
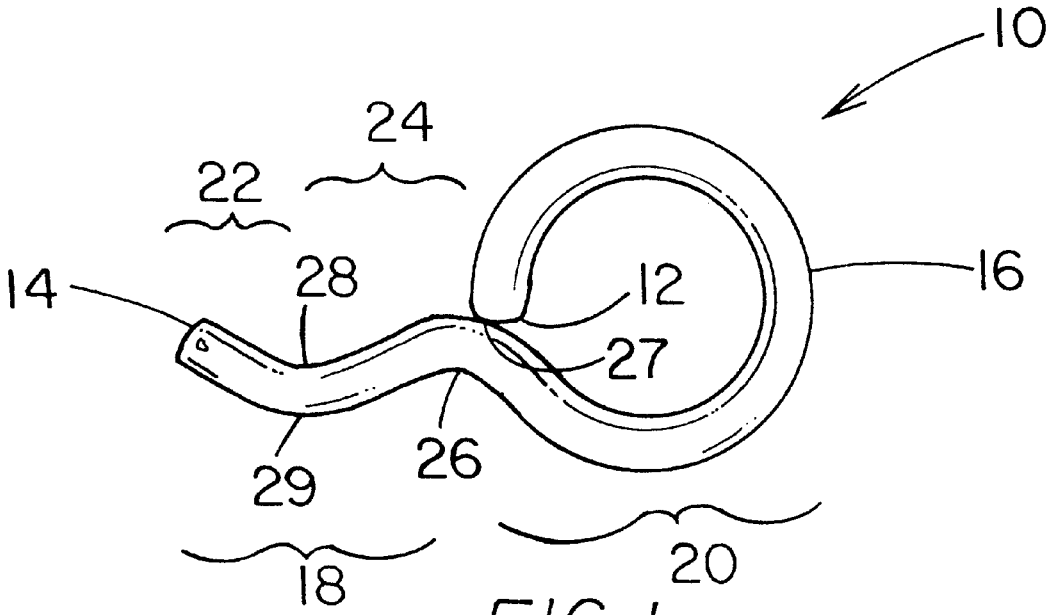
FIG. 1 is a top view of the device.

FIG. 1 depicts release 10 having rod 16 of unitary construction with rod first end 12 and rod second end 14. For reference in FIG. 1 the direction toward the top of release 10 shall be forward and the direction toward the bottom of release 10 shall be rearward. Release 10 has tail 18 and ring 20. Ring 20 is formed by bending rod 16 so that first end 12 is near or touching ring upper bend 27. Tail 18 has tail first section 22 and tail second section 24. Ring lower bend 26 is approximately opposite ring upper bend 27. Ring upper bend 27 is approximately 120 degrees. Ring lower bend 26 is approximately 120 degrees. Tail second section 24 extends in a rearward direction and straight to tail upper bend 28 and tail lower bend 29. Tail upper bend 28 is approximately 130 degrees. Tail lower bend is approximately 130 degrees. Tail first Section 22 extends in a forward direction and ends at rod second end 14. In the preferred embodiment, rod 16 is made of 3/16 inch stainless steel. In the preferred embodiment rod 16 is 4 5/8 inches long of which tail 18 is 1 1/8 inches and ring 20 is 4 5/8 inches. In the preferred embodiment, ring 20 has a diameter of 3/16 inches. Release 10 can be made in a range of sizes to the range of archer's hands.

Release 10 may be manufactured by bending rod 16 so that approximately 78 percent of the length of rod 16 is formed into an approximate circle. Next, the remaining approximate 22 percent of rod 16 which is tail 18 is bent at an angle of 120 degrees in the same plane as the circle so that tail second section 24 and tail first section 22 extend outward from the center of ring 18. Next, first tail section 22 is bent forward at an angle of approximately 150 degrees to the plane of the circle of ring 18 at the approximate midpoint of tail 18 at an angle of approximately 130 degrees.

Figure 2:
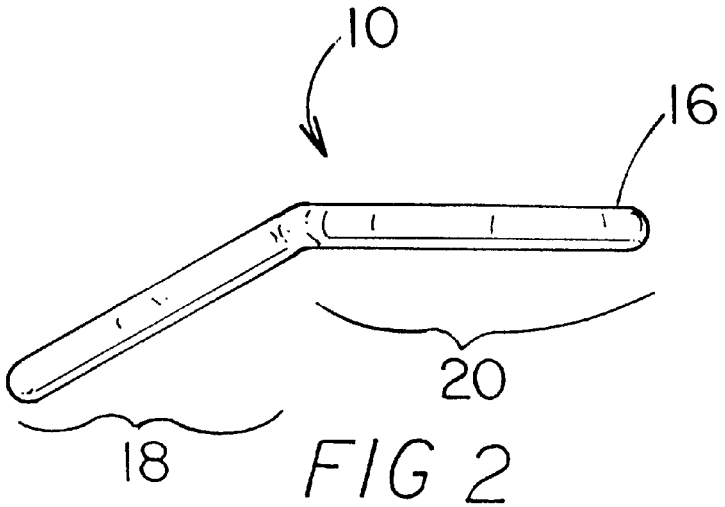
FIG. 2 is a left side view of the device.

FIG. 2 depicts a left side view of release 10. Tail 18 is bent downward from the plane of ring 20 and from ring 20 at an approximate angle of 150 degrees.

FIG. 3 depicts archer's hand 40 with thumb 42, index finger 44, middle finger 46, fourth finger 48 and fifth finger 50. Middle finger 46 is inserted into ring 20 and index finger 44 is positioned over tail 18. Index finger 44 engages tail upper bend 28. Bowstring 32 (see FIG. 4) engages ring lower bend 26. Arrow 30 is held by archer's hand 40 by squeezing between index finger 44 and middle finger 46.

FIG. 4 depicts a left side view of release 10 employed with bow string 32 drawn back. Bow string 32 is engaged with ring lower bend 26. The ring portion is placed over middle finger 46 and positioned near middle finger joint 47. To release bow string 32, the archer releases tails second section 24 (see FIG. 1) by raising index finger 44. Alternatively, the archer may release bow string 32 by sliding index finger 44 over tail first section 22 and past ring second end 14. Bow string 32 then pushes tail 18 forward rotating about ring 20 on middle finger 46. Therefore, release 10 does not rely on a forward projection or arm with notch for release of the bowstring as does the prior art. Moreover, release 10 that will provide the protection of the archer's tab while providing positive control of bow string 32 and positive control of the release of bow string 32.

Release 10 may be manufactured by the following method. First, a 3/16 inch stainless steel rod having a first end and a second is bent so that approximately 78 percent of the length of said rod is formed into an approximate circle so that the archer's index finger may be received in the circle. Second, the remaining approximate 22 percent of the rod is bent downward at an angle of approximately 150 degrees to the plane of the circle. Third, the remaining approximate 22 percent of the rod is bent at an angle of 120 degrees in the same plane as the circle. Fourth, at the approximate midpoint of the remaining 22 percent of the rod, the rod is bent at an angle of approximately 130 degrees so that a notch for the index finger is formed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A bow string release device comprising:

a ring;

a tail fixedly connected to said ring;

wherein said ring and said tail are formed from a rod; and wherein said tail is bent downward from the plane of said ring at an approximate angle of 150 degrees.

2. The bowstring release device of claim 1 wherein said rod is made from 3/16" stainless steel.

3. The bowstring release device of claim 1 further comprising:

a ring lower bend and a ring upper bend;

rod first end; and wherein said rod first end bends in an approximate circle to a point near said ring upper bend.

4. The bowstring release device of claim 1 wherein the tail further comprises:

a tail first section and a tail second section;

a tail upper bend and a tail lower bend;

wherein said tail upper bend and said tail lower bend are located between said tail first section and said tail second section; and wherein said tail upper bend and said tail lower bend are approximately 150 degrees.

5. A bow string release device comprising:

a ring;

a tail fixedly connected to said ring;

wherein said ring and said tail are formed from a rod; and wherein said tail extends at an angle of approximately 120 degrees to said ring in approximately the same plane as said ring.

6. A bow string release device for engaging a bowstring of an bow and an archer's hand having an index finger and a middle finger comprising:

a ring having a ring lower bend and a ring upper bend;

a rod having a first end and a second end;

a tail fixedly connected to said ring, said tail having a tail first section and a tail second section;

a tail upper bend and a tail lower bend;

wherein said ring and said tail are formed from the rod;

wherein said tail is bent downward from the plane of said ring at an approximate angle of 150 degrees;

wherein said tail extends at an angle of approximately 120 degrees to said ring in approximately the same plane as said ring;

wherein said rod first end bends in an approximate circle to a point near said ring upper bend;

wherein said tail upper bend and said tail lower bend are located between said tail first section and said tail second section;

wherein said tail upper bend and said tail lower bend are approximately 130 degrees; and wherein said ring rotatably engages said middle finger and said tail releaseably engages said index finger so that when said index finger releases said tail, said bow string is released.

7. The bowstring release device of claims 6 wherein said rod is made from 3/16 inch stainless steel.

* * * * *